US006793585B1

(12) United States Patent
Miyamoto et al.

(10) Patent No.: US 6,793,585 B1
(45) Date of Patent: Sep. 21, 2004

(54) SWING MEASUREMENT METHOD, GOLF SWING ANALYSIS METHOD, AND COMPUTER PROGRAM PRODUCT

(75) Inventors: Masahiko Miyamoto, Kanagawa (JP); Hiroshi Saegusa, Kanagawa (JP)

(73) Assignee: Yokohama Rubber Co., Ltd., Tokyo (JP)

( * ) Notice: Subject to any disclaimer, the term of this patent is extended or adjusted under 35 U.S.C. 154(b) by 476 days.

(21) Appl. No.: 09/690,474

(22) Filed: Oct. 18, 2000

(30) Foreign Application Priority Data

Oct. 19, 1999 (JP) ..... 11-296643

(51) Int. Cl.[7] ..... A63B 67/02; A63B 69/36; A63B 57/00

(52) U.S. Cl. ..... 473/151; 473/150; 473/152; 473/156; 473/131; 473/141; 463/3; 463/51; 273/317.2; 273/108.2; 702/150; 702/151; 702/153

(58) Field of Search ..... 473/150–156, 473/131, 138, 140, 409; 702/141, 142, 150–153; 700/90–92; 463/1–3, 49–54; 273/317, 317.1, 317.2, 108, 108.1, 108.2, 120 R, 120 A, 118 A

(56) References Cited

U.S. PATENT DOCUMENTS 3,717,857 A * 2/1973 Evans ..... 340/870.13
3,792,863 A * 2/1974 Evans ..... 473/223
4,287,809 A * 9/1981 Egli et al. ..... 89/41.21
4,298,874 A * 11/1981 Kuipers ..... 342/463
4,314,251 A * 2/1982 Raab ..... 342/463
4,545,576 A * 10/1985 Harris ..... 473/468
4,672,564 A * 6/1987 Egli et al. ..... 702/153
4,737,794 A * 4/1988 Jones ..... 342/448
4,849,692 A * 7/1989 Blood ..... 324/207.26
5,111,410 A * 5/1992 Nakayama et al. ..... 434/258
5,233,544 A * 8/1993 Kobayashi ..... 702/141
5,474,298 A * 12/1995 Lindsay ..... 473/222
5,607,361 A * 3/1997 Mastandrea et al. ..... 473/207
5,638,300 A * 6/1997 Johnson ..... 702/153
5,694,340 A * 12/1997 Kim ..... 702/141
5,772,522 A * 6/1998 Nesbit et al. ..... 473/222
5,823,878 A * 10/1998 Welch ..... 463/43
5,826,578 A * 10/1998 Curchod ..... 600/595

(List continued on next page.)

FOREIGN PATENT DOCUMENTS

JP 06-210027 8/1994
JP 10-244023 9/1998

OTHER PUBLICATIONS

Utility Model Reg. 3050448, Apr. 1998, Japan.

*Primary Examiner*—Jessica Harrison
*Assistant Examiner*—Binh-An D. Nguyen
(74) *Attorney, Agent, or Firm*—Finnegan, Henderson, Farabow, Garrett & Dunner, L.L.P.

(57) ABSTRACT

A swing measurement method of directly measuring a swing behavior without being influenced by flexure of an impact implement, such as a golf club or baseball bat is provided. In addition, a golf swing analysis method and computer program product having computer program code for a simple and effective model of the behavior of a grip portion during a golf swing is provided. A three dimensional magnetic sensor capable of measuring position and direction is fixed to a grip portion of the impact implement within magnetic fields in which the magnetic field distribution of intensity and direction are known, and the behavior of the swing is directly measured. In addition, the path of the grip portion is approximated as an arc within a swing plane using the three dimensional position coordinates of the grip portion obtained in this measurement, and thus an arm angle, a wrist angle, and an angle of shaft rotation are found. The time sequence data of the wrist angle and the time sequence data of the shaft rotation angle, with respect to the time sequence data of the arm angle are plotted and the swing behavior is analyzed.

16 Claims, 5 Drawing Sheets

U.S. PATENT DOCUMENTS 5,907,819 A * 5/1999 Johnson ..... 702/152
5,911,635 A * 6/1999 Ogden ..... 473/224
5,935,014 A * 8/1999 Lindsay ..... 473/222
5,951,410 A * 9/1999 Butler et al. ..... 473/223
5,984,684 A * 11/1999 Brostedt et al. ..... 434/252
6,083,123 A * 7/2000 Wood ..... 473/409
6,122,960 A * 9/2000 Hutchings et al. ..... 73/493

* cited by examiner

SWING MEASUREMENT METHOD, GOLF SWING ANALYSIS METHOD, AND COMPUTER PROGRAM PRODUCT

BACKGROUND OF THE INVENTION

1. Field of the Invention

The present invention relates to a swing measurement method of measuring a swing behavior of an impact implement, such as a golf club or a baseball bat having a grip portion, which is swung while the grip portion is being grasped. The swing measurement method is capable of directly and easily measuring the swing behavior without being influenced by flexure of the impact implement. In particular, the present invention relates to: a method of measuring the behavior of a golf swing directly and easily, without being influenced by the flexure of a golf shaft; to an analysis method capable of analyzing the golf swing behavior by a simple and effective model made from the obtained swing measurement data; and to a computer program product having computer program code causing a computer to analyze the golf swing behavior.

2. Description of the Related Art

Many types of golf clubs have been produced conventionally in order to pinpoint the direction of ball flight and to lengthen the carry. For example, golf clubs have been produced by considering static characteristics such as the shaft length of the golf club, the club weight, and the shaft stiffness. On the other hand, it is known that the form of the golf swing is an important element for making the flight direction of a hit ball more accurate, and for increasing the carry distance. Determining which golf club is suitable to an individual's golf swing, from the many types of golf clubs available, has conventionally been an important concern for golfers. Therefore, in order to determine which golf club is suitable for an individual's golf swing, it is desirable to directly and objectively know the characteristics of one's individual golf swing, and to select the suitable golf club from the various golf clubs available based on that knowledge.

In an Unexamined Published Japanese Patent Application (Kokai) No. 10-244023, a method of selecting a golf club suitable to an individual's swing was processed, by applying a strain gauge on a portion of a shaft of a golf club facing the direction of impact, and on a portion of the shaft facing the direction to which golfers face in an address state, perpendicular to the impact direction, measuring the deformation of the shaft during a swing from the output signals of the strain gauges during the swing and typifying the characteristics of the golf swing, and then choosing a golf club suitable to the individual's swing from among various golf clubs based on the typified golf swing. In addition, an accompanying device or the like was also proposed.

On the other hand, in an Unexamined Published Japanese Patent Application (Kokai) No. 6-210027, a golf club design method capable of designing a golf club, in which a method of measuring a golf club by obtaining data for position and rotation angle by using a video camera in at least one location, such as on a shoulder, an elbow, or a wrist, then creating a model of a golfer from solid body elements such as beam elements, truss elements, or finite elements, and a model of a golf club, capable of design changes, by solid body elements such as finite elements, and then using the models to perform a simulation of the swing, was proposed. According to this proposal, it says it has become possible to select a golf club suitable to one's individual swing by using this method.

In addition, in a Japanese Utility Model Registration No. 3050448, a device capable of validating swing form by photographing the swing form three dimensionally using a plurality of video cameras was this proposal, it says it has become possible to know the characteristics of one's individual golf swing to a certain extent.

However, the above-mentioned method of measuring the deformation of the shaft during the swing by applying strain gauges to the shaft of the golf club do not directly measure the behavior of the actual swing. Rather, they estimate the swing form from deformed shape of the shaft by comparing various deformations of the shaft during conventionally typified swing forms and the measured deformation. Further, the time sequence data obtained is shaft strain data, so the golfer who swings the golf club cannot visually understand the result of the estimation.

Furthermore, in the method of validating the swing form by photographing the swing form three dimensionally by using a plurality of video cameras, the swing form is able to be directly seen, and the validation of the swing form and the swing form characteristics can easily be understood. However, it is not easy to set up the plurality of video cameras such that a blind spot does not develop during the swing. Further, the plurality of video cameras have to be synchronous each other, therefore the set up is not easy. Even if the video cameras are appropriately arranged so that a blind spot does not develop, for the data for the movement of the golf club head, a grip portion, and elbow and arm movement acquired sequentially in time, the resolution of the data is limited to be low. In particular, there are problems in that the rotation angle data, such as that for the wrist returning movement of the grip portion, is difficult to measure, and the measurement is performed with even lower precision. Furthermore, since many images are obtained using a plurality of video cameras, total amount of image data becomes enormous, and there becomes a problem that much efforts are needed in handling the enormous data for data processing.

With the method of performing a simulation by modeling the golfer using solid elements using elements such as beam elements, truss elements, or finite elements in order to investigate golf club behavior, data such as the physical data of the model and shape data must be input, and intricate preparations are necessary before performing the simulation. Furthermore, the swing characteristics cannot be typified simply with a solid body model using beam elements, truss elements, or finite elements.

The above problems which thus arise during the measurement of the swing form are not limited to the golf swing, and there are common problems in various swings using an impact implement, such as a baseball bat swing, a tennis racket swing, and a badminton racket swing.

SUMMARY OF THE INVENTION

The present invention has been made to solve the above-mentioned problem, and therefore has an object to provide a swing measurement method capable of easily obtaining time sequence measurement data by directly measuring a swing behavior of an impact implement having a grip portion, such as a baseball bat, a tennis racket, or a badminton racket, when the grip portion is grasped and swung, without being influenced by flexure of the impact implement. In particular, an object of the present invention is to provide a swing measurement method capable of easily obtaining time sequence measurement data by directly measuring a golf swing behavior of a golfer without being influenced by flexure due to a golf shaft. In addition, an object of the present invention is to provide a method of analyzing a golf swing capable of obtaining the behavior of a golf club grip portion using a simple and effective model, without using a solid element model such as a beam element, a truss element, or a finite element model.

In order to achieve the above and other objects, according to a first aspect of the present invention, there is provided a swing measurement method for measuring a swing behavior during a swing with an impact implement grasped on a grip portion thereof, comprising the steps of fixing a three dimensional magnetic sensor to the grip portion of the impact implement, forming magnetic fields, each distribution of intensity and direction thereof being known, within a range of motion of the grip portion, so that the three dimensional magnetic sensor senses magnetism of each of the formed magnetic fields for outputting signals corresponding to three dimensional position of the grip portion with respect to a predetermined point, and to pointing direction of the grip portion with respect to a predetermined direction, and acquiring at least one of three dimensional position coordinates data of the grip portion and pointing direction data of the grip portion from the output signals.

In particular, the impact implement is a golf club, and the three dimensional position coordinates data and the pointing direction data, are acquired during the swing of the golf club.

Further, it is preferable that the three dimensional position coordinates data and the pointing direction data, represent the swing behavior of the grip portion at least from a top state to an impact state of the swing.

Further, it is preferable that the three dimensional magnetic sensor fixed to the grip portion has three mutually orthogonal axes for sensing, one direction of an axis from among the three mutually orthogonal axes being aligned with a direction of an axis of a shaft of the golf club, and one direction of an axis from among the other two axes being aligned with an impact direction of the golf club.

Further, it is preferable that the three dimensional magnetic sensor is fixed to the end of the grip portion.

Further, according to a second aspect of the present invention, there is provided a golf swing analysis method for analyzing a swing behavior of a golf club, comprising the steps of receiving time sequence data of three dimensional position coordinates of a grip portion of the golf club, and time sequence data of pointing direction of the grip portion during a golf swing from a data acquisition means, calculating a swing plane, on which a swing path of the grip portion is approximated, from the time sequence data of the three dimensional position coordinates, projecting the swing path of the grip portion on the swing plane and approximating the projected swing path as an arc to obtain the arc as a swing path arc of the grip portion, and obtaining arm angle time sequence data of an arm angle showing a position of the grip portion on the swing plane from the time sequence data of three dimensional position coordinates and the swing path arc, and at least one time sequence data from the group consisting of wrist angle time sequence data of a wrist angle found based on a shaft direction angle obtained from the pointing direction of the grip portion and showing a shaft direction of the golf club on the swing plane, and rotation angle time sequence data of a shaft rotation angle, around a shaft axis of the golf club, from the pointing direction.

It is preferable that the wrist angle is found by subtracting the arm angle from the shaft direction angle.

It is also preferable that the swing plane of the grip portion is calculated using the swing path of the grip portion including the swing behavior at least from a top state of the golf swing to an impact state.

Further, it is also preferable that the swing path arc of the grip portion is calculated using the projected swing path including the swing behavior at least from a top state of the golf swing to an impact state.

Further, it is preferable that the arm angle time sequence data, and at least one of the wrist angle time sequence data and the rotation angle time sequence data, represent the swing behavior at least from a top state of the golf swing to an impact state.

Further, it is preferable that the swing behavior of the grip portion is analyzed by plotting at least one time sequence data, from among the wrist angle time sequence data and the rotation angle time sequence data, against the arm angle time sequence data.

Further, it is preferable that the data acquisition means has a three dimensional magnetic sensor and a means for forming magnetic fields, each distribution of intensity and direction thereof being known, so that the three dimensional magnetic sensor senses magnetism of each of the formed magnetic fields for outputting signals corresponding to three dimensional position of the three dimensional magnetic sensor with respect to a predetermined point, and to pointing direction of the three dimensional magnetic sensor with respect to a predetermined direction, acquires the time sequence data of the three dimensional position coordinates and the time sequence data of the pointing direction, by fixing the three dimensional magnetic sensor to the grip portion and forming the magnetic fields within a range of motion of the grip portion during the golf swing.

It is also preferable that the data acquisition means uses at least one camera from the group consisting of a high speed camera, a CCD camera, and a strobe photography camera, and the time sequence data of the three dimensional position coordinates and the time sequence data of the pointing direction during the golf swing, are acquired by performing measurements from images obtained by the camera.

Furthermore, according to a third aspect of the present invention, there is provided a computer program product, comprising a computer readable medium having computer program code embodied for an analysis of swing behavior of a golf club, the computer program code including computer program code configured to cause a computer to receive time sequence data of three dimensional position coordinates of a grip portion of the golf club and time sequence data of pointing direction of the grip portion during a golf swing from a data acquisition means, computer program code configured to cause a computer to compute a swing plane, on which a swing path of the grip portion is approximated, from the time sequence data of the three dimensional position coordinates, computer program code configured to cause a computer to project the swing path of the grip portion on the swing plane and approximate the projected swing path as an arc to obtain the arc as a swing path arc of the grip portion, and computer program code configured to cause a computer to obtain arm angle time sequence data of an arm angle showing a position of the grip portion on the swing plane from the time sequence data of the three dimensional position data and the swing path arc, and at least one time sequence data from the group consisting of wrist angle time sequence data of an wrist angle found based on a shaft direction angle obtained from the time sequence data of the pointing direction and showing a shaft direction of the golf club on the swing plane, and rotation angle time sequence data of a shaft rotation angle, around a shaft axis of the golf club, from the pointing direction.

It is preferable that the wrist angle is found by subtracting the arm angle from the shaft direction angle.

Further, it is preferable that the swing plane is computed using the swing path of the grip portion including the swing behavior at least from a top state of the golf swing to an impact state.

It is preferable that the swing path arc of the grip portion is computed using the projected swing path including the swing behavior at least from a top state of the golf swing to an impact state.

It is also preferable that the arm angle time sequence data, and at least one of the wrist angle time sequence data and the rotation angle time sequence data, represent the swing behavior at least from a top state of the golf swing to an impact state.

Further, it is preferable that the computer program code also includes computer program code configured to cause a computer to plot at least one time sequence data, from among the wrist angle time sequence data and the rotation angle time sequence data, against the arm angle time sequence data.

DETAILED DESCRIPTION OF THE PREFERRED EMBODIMENTS

A swing measurement method and a golf swing analysis method of the present invention are explained in detail below based upon the preferred embodiments shown in the attached figures.

The swing measurement method of the present invention is a measurement method applied in cases of measuring a swing behavior when swinging using an impact instrument, such as a baseball bat swing, a tennis racket swing, or a badminton swing. An example of a swing using a golf club is given and explained below.

Figure 1:
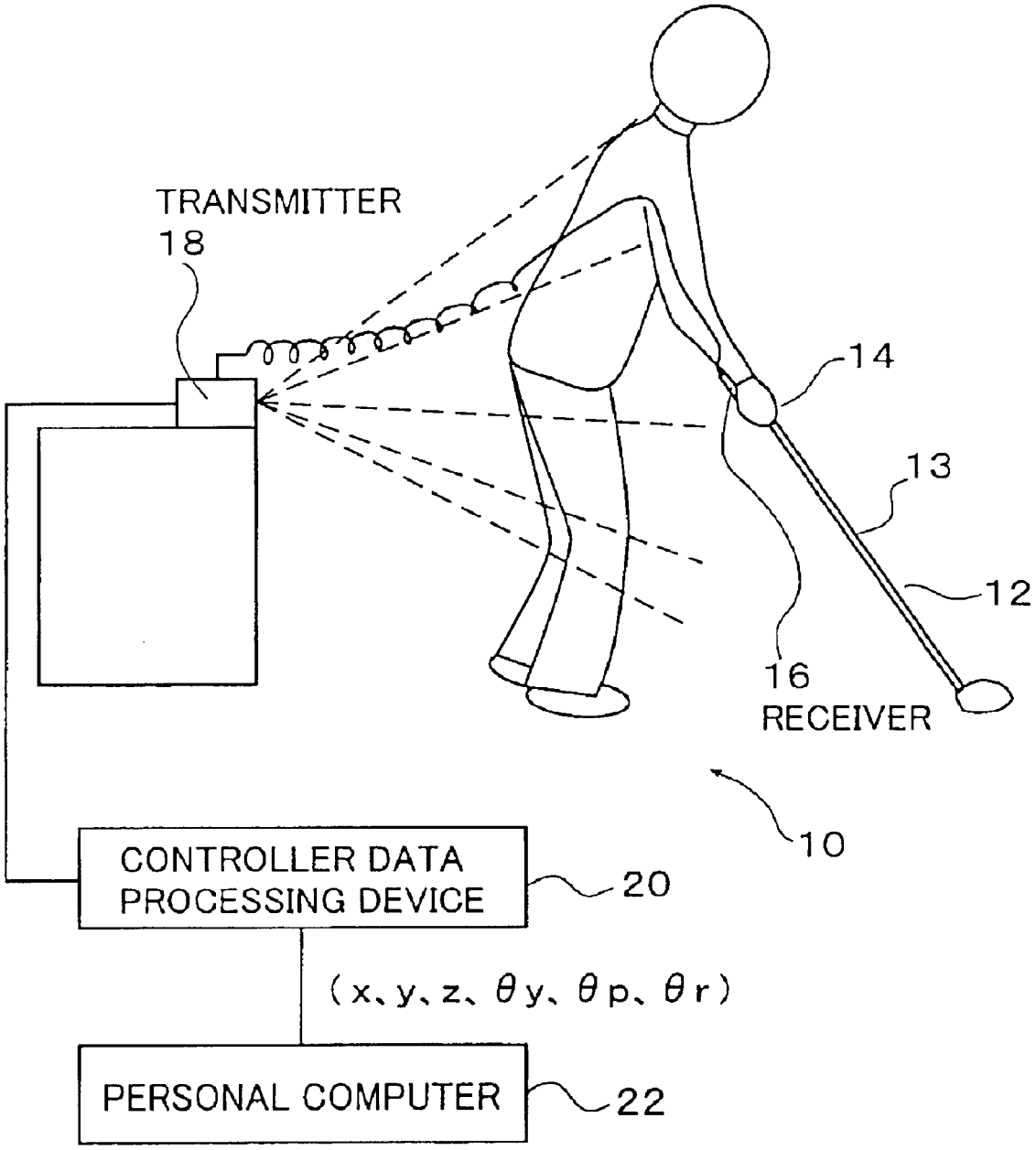
FIG. 1 is a schematic drawing showing an example of applying a swing measurement method of the present invention to a golf swing.

FIG. 1 is a schematic diagram showing an example of the swing measurement method of the present invention applied to a golf swing. The example shown in FIG. 1 is a method of acquiring time sequence data of the behavior of a grip portion during a golf swing using a three dimensional position and pointing direction measurement system (hereafter referred to as a measurement system) 10. A receiver 16, a magnetic sensor of the measurement system 10 stated below, is attached at the edge portion of a grip portion 14 placed at the end of a shaft 13 of a golf club 12.

For the measurement system 10, three types of predetermined magnetic fields develop one after another from a transmitter 18 (means for forming magnetic fields) fixed in position on the back of a person performing a golf swing. Magnetisms of the three magnetic fields are sensed by a receiver 16 (three dimensional magnetic sensor) fixed in the grip portion 14 moving and rotating, corresponding to position and pointing direction thereof within the three types of magnetic fields formed by the transmitter 18. Nine output voltage signals are output totally, and from these output voltage signals data processing is performed by a controller data processing device 20, and position data and pointing direction data of the receiver 16 are obtained.

Figure 2:
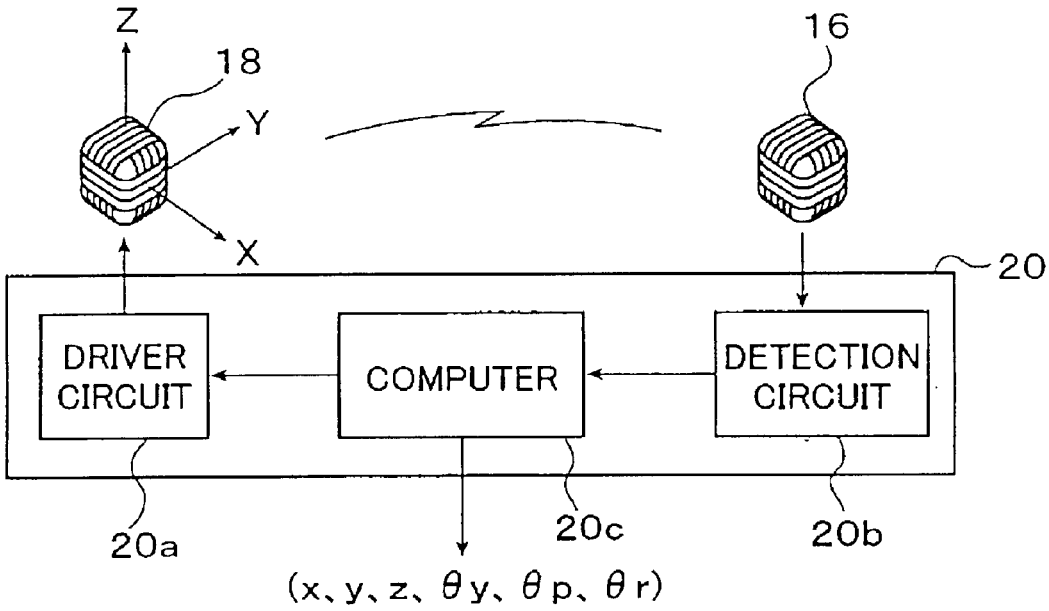
FIG. 2 is a drawing showing an example of a measurement system using the swing measurement method of the present invention.

As shown in FIG. 2, the measurement system 10 has:

the transmitter 18 for forming predetermined magnetic fields;

the receiver 16 for generating three axis direction output voltage signals corresponding to intensity and direction of the magnetic field; and a controller data processing device 20 having a driver circuit 20*a* for generating driver signals for developing the three types of predetermined magnetic fields in the transmitter 18; a detection circuit 20*b* for detecting the output signals from the receiver 16; and a computer 20*c* for controlling the driver circuit 20*a*, for performing data processing from the output voltage signals obtained, and for computing time sequence data of three dimensional coordinates (x, y, z) based on three mutually orthogonal coordinate system, which has axes X, Y, Z taking a predetermined point, for example, a center position of the transmitter 18 as the origin thereof, and time sequence data of posture angles, yaw angle, pitch angle, and roll angle (hereafter expressed as $\theta_y$, $\theta_p$, $\theta_r$) expressing pointing direction of the receiver with respect to a predetermined direction, for example, the Y axis direction of the three mutually orthogonal coordinate system.

Each of the transmitter 18 and the receiver 16 has three coils wound in loop shapes in directions of three mutually orthogonal axes respectively, as shown in FIG. 2, and the transmitter 18 is fixed in place behind the person performing the golf swing, and the receiver 16 is fixed in an edge portion of a grip portion 14 of the golf club 12.

The controller data processing device 20 has the driver circuit 20*a*, the detection circuit 20*b*, and the computer 20*c* which performs control of the driver circuit 20*a* and the detection circuit 20*b*, and is prepared with data processing software for getting the three dimensional position and pointing direction of the receiver 16 from output voltage signals Vs sent from the detection circuit 20*b*.

The transmitter 18 is connected to the driver circuit 20*a* inside the controller data processing device 20, and the receiver 16 is connected to the detection circuit 20*b* inside the controller data processing device 20, respectively.

The measurement system 10 is thus structured as above. Note that the time sequence data of the three dimensional position coordinates (x, y, z) of the receiver 16 fixed to the grip portion 14 with respect to the predetermined point, and the time sequence data of the posture angles ($\theta_y$, $\theta_p$, $\theta_r$) of the receiver 16 with respect to the predetermined direction are obtained as shown below.

As shown in FIG. 2, the driver circuit 20*a* outputs identical signals in which frequency and phase are normally constant, and the three loop shape coils wound in the three axis directions of the transmitter 18 are excited in order. Based on such, three different magnetic fields developed in each loop shape coil due to the excitation, and three independent output voltage signals Vs are generated in the three loop shape coils wound in the three axis directions of the receiver 16. In other words, three output voltage signals Vs are generated in the three loop shape coils of the receiver 16, corresponding to each of the three magnetic fields excited by the three loop shape coils of the transmitter 18, therefore a total of 9 (3×3) output voltage signals Vs are obtained.

On the other hand, the transmitter 18 which forms the magnetic fields is fixed in a predetermined point and in a predetermined direction, and therefore distributions of intensity and direction of the magnetic fields become known with respect to the predetermined point and the predetermined direction. By using the 9 output voltage signals Vs, subjected to A/D conversion, which develop due to the formed magnetic fields, the 6 unknown values of the three dimensional position coordinates (x, y, z) of the receiver 16, with respect to the predetermined point, and the posture angles ($\theta_y$, $\theta_p$, $\theta_r$) of the receiver 16, with respect to the predetermined direction, can be extracted.

The three dimensional position coordinate (x, y, z) data and the posture angle ($\theta_y$, $\theta_p$, $\theta_r$) data are computed in the computer 20*c* of the controller data processing device 20 by using the 9 output voltage signals Vs sent from the detection circuit 20*b*.

The three dimensional position coordinates (x, y, z) and the posture angles ($\theta_y$, $\theta_p$, $\theta_r$) obtained by the measurement system are introduced to a personal computer 22, and time sequence data for the behavior of the grip portion 14 during the swing can be obtained.

Note that in this embodiment, as shown in FIG. 2, the coils are wound in three mutually orthogonal axis directions of the receiver 16, and therefore the receiver 16 is fixed to the end portion of the grip portion 14 of the golf club 12 with pointing direction of the receiver 16 established so that one of the three axis directions is aligned with an axis direction of the shaft 13, and in addition, one of the remaining two axis directions is aligned with an impact direction of the golf club. By doing so, the time sequence data of the rotation angle around the golf club shaft, and a wrist angle, namely, as mentioned later an angle calculated by subtracting an arm angle showing the position of the grip portion 14 from a shaft direction angle of the shaft 13 on the swing plane of the grip portion 14 during the swing, can be obtained. When fixing the receiver 16 in the golf swing measurement method of the present invention, there are no particular limitations placed on the direction of the receiver 16, and it may be fixed in any direction. However, it is preferable to fix the receiver 16 in place so that it is aligned with the axis direction of the shaft 13 and the impact direction of the golf club 12.

A Fasttrak II system (produced by Polhemus Corporation) can be given as an example of this type of measurement system 10. Conventionally, when performing image measurements from images taken by a CCD video camera, the sampling period of the captured image is 1/60 seconds, and measurement resolution of the position of the grip portion is from 1 to 2 mm, but the time sequence data of the Fasttrak II system are acquired in a sampling period of, for example, 1/120 seconds, measurement resolution of 0.8 mm, and a rotational angular resolution of 0.15 degrees. More detailed information regarding behavior of the grip portion 14 during the swing can therefore be obtained, because the sampling period is shorter, and the resolution higher, compared to that of conventional methods.

Furthermore, measuring the rotation angle of the shaft of the golf club, and the wrist angle, by image measurements of images captured by CCD video camera is difficult by nature. For example, even though measurements can be performed by attaching a special jig to the golf club, the rotation angle around the shaft axis data and the wrist angle data cannot be obtained at a resolution so much high as that of the measurement system by magnetic field of the present invention, for example the 0.15 degrees resolution of the Fasttrak II system.

In addition, at most, on the order of 2 seconds of swing data, for example the three dimensional position coordinates (x, y, z) and the posture angles ($\theta_y$, $\theta_p$, $\theta_r$) for a total of 6 types of data, are obtained with the Fasttrak II system. Compared to performing image measurements by capturing images by CCD video camera and then analyzing the images, the amount of data handled is extremely low in the Fasttrak II system, and the processing speed is also overwhelmingly fast.

In addition, at most, on the order of 2 sec of swing data, for example the three dimensional position coordinates (x, y, z) and the posture angles ($\theta_y$, $\theta_p$, $\theta_r$) for a total of 6 types of data, are obtained with the Fasttrak II system. Compared to performing image measurements by capturing images by CCD video camera and then analyzing the images, the amount of data handled is extremely low in the Fasttrak II system, and the processing speed is also overwhelmingly fast.

Further, with a method of measuring strains of the shaft 13 by attaching strain gauges or the like to the shaft 13, the swing behavior of the golfer cannot be directly measured without being influenced by flexure of the shaft 13 when measuring the strain of the shaft. However, with the swing measurement method of the present invention, the swing behavior of the golfer can be easily and speedily measured without being influenced by flexure of the shaft 13.

The receiver 16 is attached to the edge portion of the grip portion 14 of the shaft 13 in this embodiment, but there are no limitations on the placement, and receiver 16 may be placed at any part of the grip portion, provided it is a location having little flexure substantially.

Further, as stated above, the present invention is not limited to the golf swing, and the swing form itself can be directly measured, without being influenced by flexure of the impact implement, for various types of swings using impact implements.

The time sequence data thus obtained of the three dimensional position coordinates (x, y, z) and the posture angles ($\theta_y$, $\theta_p$, $\theta_r$) of the grip portion 14 during the swing, are used, for performing analysis of the golf swing, explained below.

Figure 3:
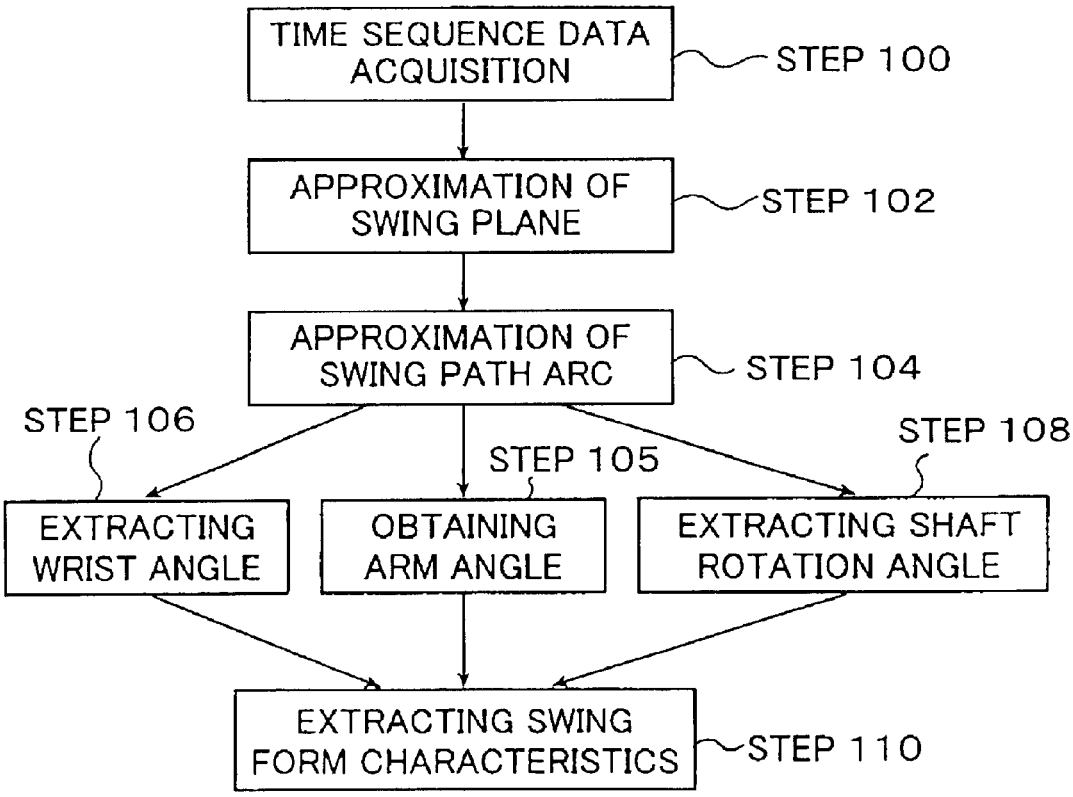
FIG. 3 is a flow chart showing an example of a flow of a golf swing analysis method of the present invention.

FIG. 3 is a flow chart showing an example of a golf swing analysis method of the present invention. The series of steps, from a step 100 of obtaining time sequence data of the three dimensional position coordinates (x, y, z), and the posture angles ($\theta_y$, $\theta_p$, $\theta_r$) of the grip portion 14, to a step 110 of finally extracting form characteristics of the golf swing using the time sequence data, is processed by software inside the personal computer 22 shown in FIG. 1.

Figure 4:
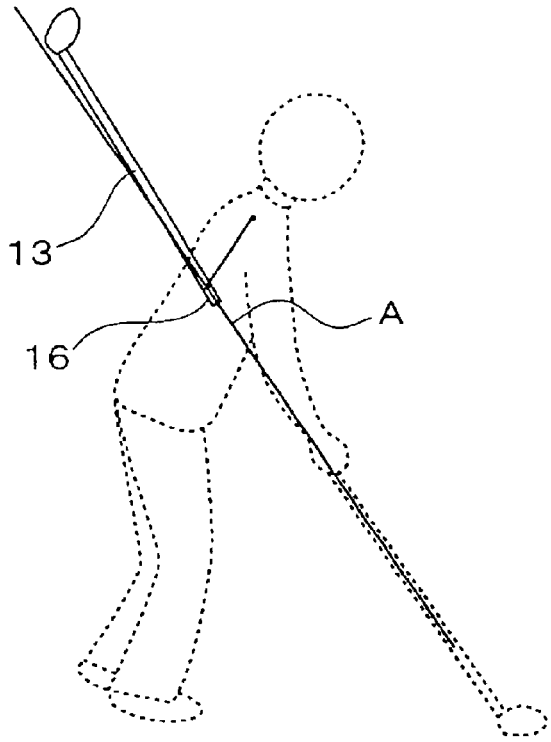
FIG. 4 is a drawing for explaining a swing plane used in the golf swing analysis method of the present invention.

First, time sequence data of the three dimensional position coordinates (x, y, z), and time sequence data of the posture angles ($\theta_y$, $\theta_p$, $\theta_r$), of the grip portion 14 are obtained in the step 100 by the golf swing measuring method using the present invention as mentioned above, and the behavior of the grip portion 14, including at least the behavior from a top state during the swing to a ball impact state, is approximated on a plane, and obtain the plane as a swing plane A in a step 102. The swing plane A is computed from a plane sloping to the left when facing the impact direction from behind a golfer (a right-handed golfer), as shown in FIG. 4. This type of approximation can be made by regressing the time sequence data of the three dimensional position coordinates (x, y, z) of the grip portion 14 from the top state to the impact state into a plane (which has an equation) $C_1x+C_2y+C_3z=C_4$ (where $C_1$, $C_2$, $C_{C3}$, and $C_4$ are constants), using a least square method. In general, the more advanced a golfer is, the more precisely a swing path of the grip portion from a top state to the impact state during his or her swing is formed on a plane, a swing plane. For cases of beginner or intermediate golfer as well, the swing path of the grip portion during his or her swing, can be approximated on a plane, namely a swing plane. The swing plane A changes, of course, in accordance with the golfer.

When the swing planes As of 30 golfers are obtained by the approximation of this method, an average correlation coefficient of 0.97 is returned for the swing planes As, and the minimum correlation coefficient indicates 0.94. It is therefore understood that the path of the grip portion can sufficiently be approximated on the swing plane A.

Figure 5:
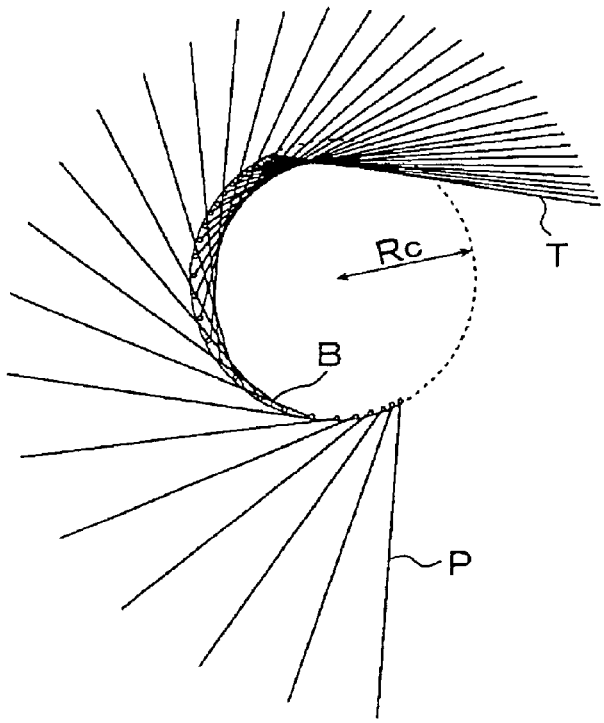
FIG. 5 is a drawing for explaining a swing path arc used in the golf swing analysis method of the present invention.

In FIG. 5, the three dimensional position coordinates (x, y, z) are projected on the swing plane A thus computed, and in addition, information on the pointing direction of the shaft 13 of the golf club computed from the time sequence data of the posture angles ($\theta_y$, $\theta_p$, $\theta_r$) is added, and the behavior of the grip portion 14 from a top state T to an impact state P is shown in the figure.

A motion of the grip portion 14 is seen to be regressed into an arc, as shown in the figure. It is also understood that the pointing direction of the grip 14, in other words, the pointing direction of the shaft 13 of the golf club changes along with the motion of the grip portion 14.

The motion of the grip portion 14 is then approximated by an arc, and a swing path arc B is obtained from the arc in a step 104. The calculation of the swing path arc B is performed by taking two dimensional coordinates ($x_n$, $y_n$), (n=1 to N, and N is the number of time sequence data from the top state T to the impact state P) projected on the swing plane A of the three dimensional position coordinates (x, y, z), from the top state T to the impact state P obtained in the step 100, and finding appropriate values of $R_c$, $x_c$, and $y_c$ which show a radius and a center position of the approximated arc, respectively, by inputting some values to $R_c$, $x_c$, and $y_c$, such that the dispersion value S of Eq. 1 below becomes equal to or less than 30 mm.

$$S = \sqrt{\frac{\sum_{n=1}^{N} \left(\sqrt{(x_n - x_c)^2 + (y_n - y_c)^2} - Rc\right)^2}{N-1}}$$

In other words, taking the dispersion value S (standard deviation) of the difference between the distance from the center position of the approximated arc to the position determined by the two dimensional coordinates ($x_n$, $y_n$) and the radius of the approximated arc as a measure for approximation judgement, when the dispersion value S is within 30 mm, it is judged that the swing path arc B of the grip portion 14 is approximated appropriately.

Alternatively, the computation of the radius $R_c$ of the swing path arc B, and the center positions $x_c$ and $y_c$ may also be found using a successive approximation method, for example a well-known method such as a Newton method, and optimal values of $R_c$, $x_c$, and $y_c$, may be determined while successively finding the values $S_s$ of Eq. 1

For example, when the swing path arcs Bs of 30 golfers are found by the above method, $R_c$ is 45 cm on average, with an average dispersion value of approximately 2 cm. Further, the average correlation coefficient is 0.92, and it is understood that it is possible to approximate the behavior of the grip portion 14 by the swing path arc B.

Next, an arm angle which shows a position of the grip portion 14 is obtained in a step 105, and extraction of the wrist angle in the swing path arc B thus found is performed in a step 106, and extraction of the rotation angle of the shaft 13 is performed in a step 108.

Figure 6A:
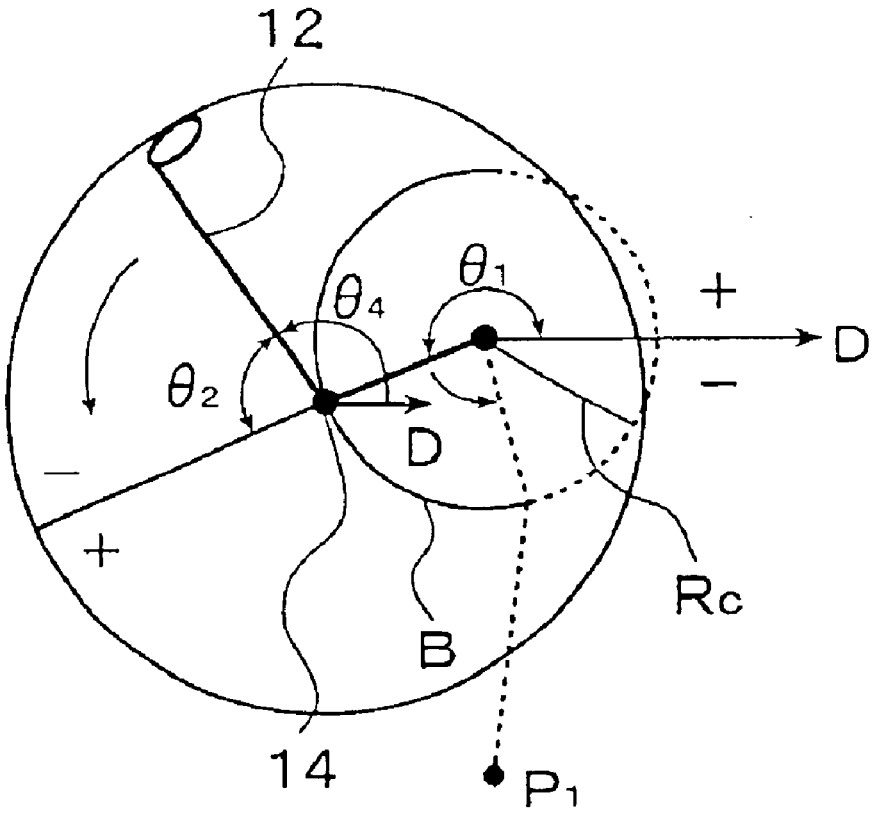
FIG. 6A is a drawing for explaining an arm angle and a wrist angle used in the golf swing analysis method of the present invention.

FIG. 6A shows a method of obtaining an arm angle $\theta_1$, and a wrist angle $\theta_2$ from the swing path arc B. Note that a D direction is an impact direction of impact, a point $P_1$ is a position at which the impact is imparted to a golf ball. In addition, the behavior of the golf club 12 during the time from a top state through a downswing is shown in the figure.

As for the arm angle $\theta_1$ by taking the angle of the impact direction D as 0 degrees, and the counter clockwise direction from the impact direction D in the figure as positive, the arm angle $\theta_1$ is obtained to show a position of the grip portion 14 from the three dimensional coordinates (x, y, z) and the center position of the swing path arc B, as shown in FIG. 6A (step 105). In addition, at the top state the arm angle $\theta_1$ is near a range of 90 to 135 degrees, and at the impact state, it has a range slightly exceeding 270 degrees.

The wrist angle θ2 is established that a direction of a straight line taken from the center position of the swing path arc B to a moving position of the grip portion 14 be a direction with 0 degrees of the wrist angle, and on the basis of this direction, a direction in which the shaft 13 of the golf club 12 proceeds in the impact direction is taken as positive, while the opposite direction is taken as negative. In other words, the wrist angle $\theta_2$ is defined as the direction of the shaft 13 of the golf club 12, namely by an angle obtained by subtracting the arm angle $\theta_1$ showing a position of the grip portion 14 from an angle $\theta_4$ with respect to the D direction shown in the figure, and the wrist angle $\theta_2$ is extracted based on this definition. The golf club 12 shows a negative wrist angle in the figure. The wrist angle $\theta_2$ is thus extracted from the swing path arc B (step 106).

Figure 6B:
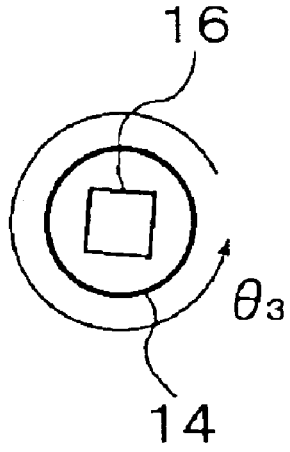
FIG. 6B is a drawing for explaining a shaft rotation angle used in the golf swing analysis method of the present invention.

As for the rotation angle $\theta_3$, a clockwise direction is taken as the positive direction on the basis of the predetermined direction seeing from the end portion of the grip portion 14, as shown in FIG. 6B. This type of rotation angle $\theta_3$ around the axis of the shaft 13 (hereafter referred to as a shaft rotation angle) is an angle around the shaft 13 positioned on the sloped swing plane A, and therefore the value of the shaft rotation angle $\theta_3$ is extracted in the step 108 from the time sequence data of the posture angles ($\theta_y$, $\theta_p$, $\theta_r$) by computing with respect to the slope of the swing plane A. If one axis of the three axes of the receiver 16 is aligned in the axis direction of the shaft 13, then one of the posture angles ($\theta_y$, $\theta_p$, $\theta_r$), for example $\theta_r$, becomes the shaft rotation angle $\theta_3$, and it is not necessary to perform calculations.

Note that the arm angle $\theta_1$, the wrist angle $\theta_2$, and the shaft rotation angle $\theta_3$ are obtained in the above embodiment based on the time sequence data of the three dimensional position coordinates and the posture angles around the three orthogonal axes which are obtained by the measurement system 10 utilizing the magnetic fields. However, the golf swing analysis method is not limited to using the measurement system 10, and the arm angle $\theta_1$, the wrist angle $\theta_2$, and the shaft rotation angle $\theta_3$ may also be obtained from three dimensional position coordinates and posture angles around three mutually orthogonal axes obtained by performing image measurement on images captured by a camera, such as a high speed camera, a CCD camera, or a strobe photography camera.

The relationship between the arm angle $\theta_1$ and the wrist angle $\theta_2$, and the relationship between the arm angle $\theta_1$ and the shaft rotation angle $\theta_3$ are arranged for extracting the characteristics of the swing form in the step 110.

Figure 7A:
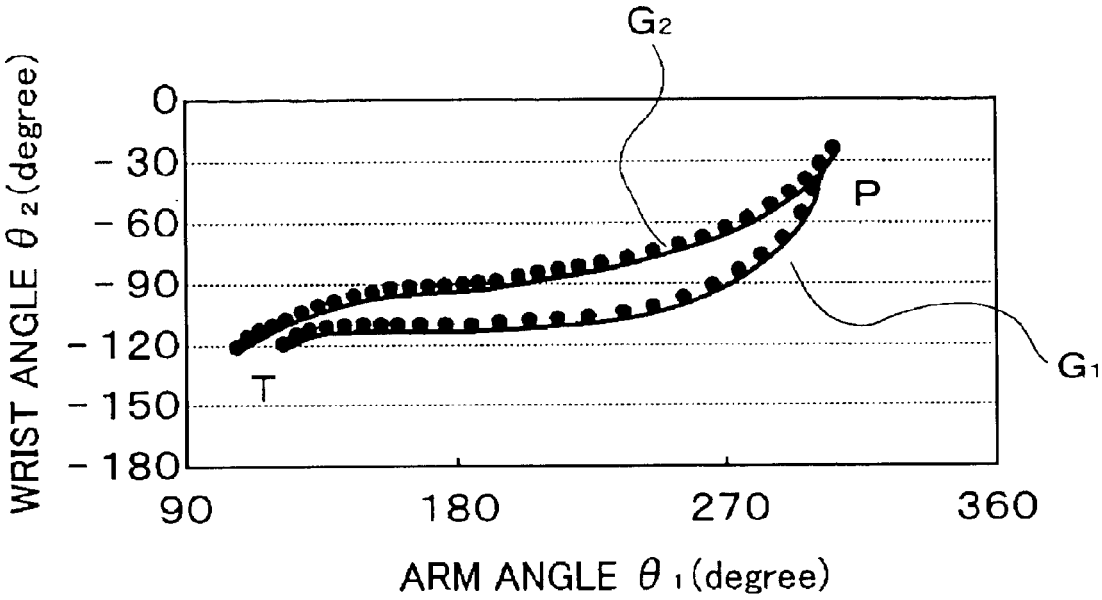
FIGS. 7A and 7B are figures for explaining an example of the characteristics of a swing form extracted in accordance with the golf swing analysis method of the present invention.

For example, FIG. 7A shows the relationship between the arm angle $\theta_1$ and the wrist angle $\theta_2$. Changes in the wrist angle $\theta_2$ from the top state T during the downswing of the golf club 12 until the impact sate P are shown for two people, a golfer $G_1$ and a golfer $G_2$.

It can be seen that the wrist angle $\theta_2$ from the top state T to a state at which the arm angle $\theta_1$ is 240 deg remains approximately −110 deg for the golfer $G_1$, and the wrist angle $\theta_2$ changes abruptly in a narrow range from there to the impact state P. On the other hand, compared to the golfer $G_1$, the golfer G2 has smooth changes in the wrist angle $\theta_2$. It is thus understood that, compared with the golfer $G_2$, the golfer $G_1$ possesses the characteristics of a swing with a strong wrist cock.

Figure 7B:
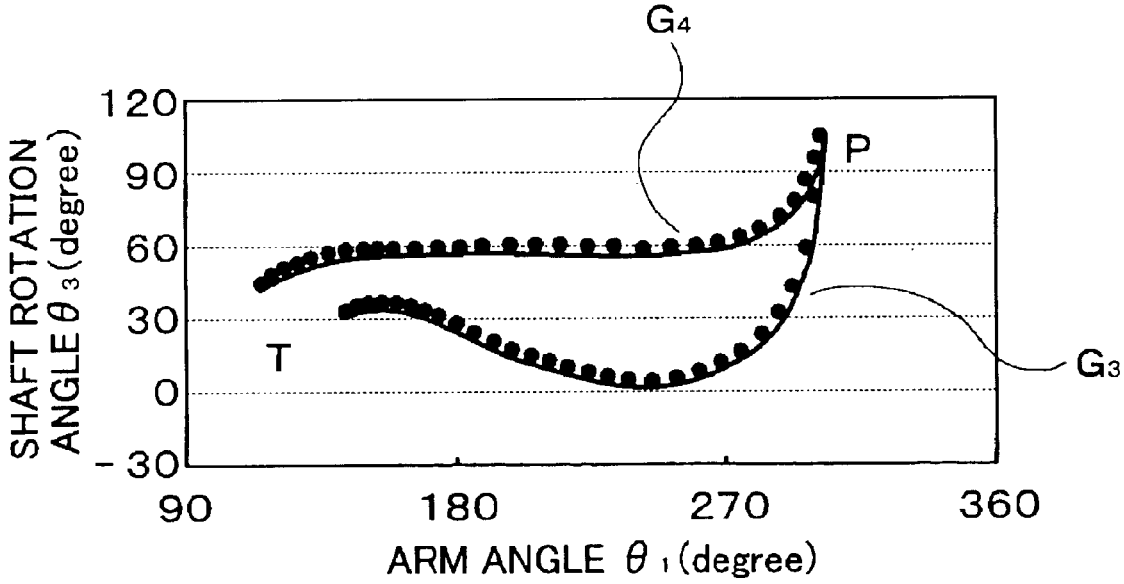

Furthermore, FIG. 7B shows the relationship between the arm angle $\theta_1$ and the shaft rotation angle $\theta_3$ as another example. FIG. 7B shows the changes in the shaft rotation angle $\theta_3$ during the downswing of two people, a golfer $G_3$ and a golfer $G_4$, from the top state T to the impact state P.

The golfer $G_4$ has a constant shaft rotation angle $\theta_3$ of approximately 60 degrees from the top state to a state at which the arm angle $\theta_1$ is 270 degrees, and the shaft angle $\theta_3$ then changes abruptly in a narrow range from that location to the impact state P. On the other hand, the golfer $G_3$ does not maintain a constant shaft angle $\theta_3$ it is always changing. It is thus understood that, compared to the golfer $G_3$, the golfer $G_4$ possesses the characteristics of a swing with weak roll.

The swing characteristics of golfers can thus be easily and clearly classified using a simple two dimensional, three axis model with the arm angle $\theta_1$, the wrist angle $\theta_2$, and the shaft rotation angle $\theta_3$ in the swing path arc B, having a radius of $R_c$ on the swing plane A, as parameters.

The swing measurement method and the golf swing analysis method of the present invention explained above can quickly and easily be performed by the measurement system 10 and the software processing of the personal computer 22, and the swing characteristics of the golfer become known. Therefore, a golf club can quickly and easily be selected corresponding to an individual golfer's swing characteristics.

For example, a golfer who swings with a strong wrist cock may select a golf club with a shaft having a high flexural rigidity, while a golfer possessing a strong roll may select a golf club with a shaft having a high torsional rigidity.

Further, by imparting the radius $R_c$ of the swing path arc B, the arm angle $\theta_1$, the wrist angle $\theta_2$, and the shaft rotation angle $\theta_3$ obtained to a swing test robot, which automatically performs a golf swing and impacts a ball by using a golf club, as a swing behavior input signals, and by further using this as the swing behavior input data for a golf club model which is modeled by finite elements or the like, the design of a golf club corresponding to the characteristics of the golf swing, for example, design in which static properties and material properties such as the rigidity distribution of the shaft, the mass of the golf club head or the like, and design of the shaft shape, can effectively be performed.

In addition, the analysis method of the present invention may also be implemented by recording program code embodying the above analysis method on a computer program product comprising a known recording medium, such as a floppy disc, a CD-ROM, or a DVD and invoking the program code within the personal computer 22. In other words, the program code which implements to cause a computer: to receive time sequence data for the three dimensional position coordinates (x, y, z), and for the posture angles ($\theta_y$, $\theta_p$, $\theta_r$), of the grip portion of the golf club during the swing; to compute the swing plane of the grip portion from the time sequence data of the three dimensional position coordinates (x, y, z); to compute the swing path arc of the grip portion; and to obtain the arm angle time sequence data, and at least one of the wrist angle time sequence data, and the rotation angle around the shaft axis time sequence data; and which is recorded on a recordable medium may be invoked to implement the analysis method of the present invention.

The swing measurement method, the golf swing analysis method, and the computer program product of the present invention are explained above, but the present invention is not limited to the above embodiments. Within a range which does not deviate from the scope of the present invention, it is of course possible to improve or change each portion of the present invention.

As explained in detail above, in accordance with the swing measurement method of the present invention, by measuring the behavior of a grip portion of an impact implement within magnetic fields having known intensity and direction distributions, and using a magnetic sensor for sensing the magnetic fields without being influenced by flexure, swing behavior in particular golf swing behavior can simply and easily be obtained without influence due to a shaft or the like.

Furthermore, in accordance with the golf swing analysis method of the present invention, by approximating the behavior of the grip portion during the swing on a swing plane, and in addition by approximating the swing path of the grip portion by an arc, the behavior of the grip portion of the golf club characterizing the golf swing can be obtained using a simple and effective model. In other words, an arm angle, a wrist angle, and a shaft rotation angle of the grip portion moving around the arc can be defined, and the swing characteristics can be easily and clearly extracted.

What is claimed is:

1. A swing measurement method for measuring a swing behavior during a swing with an impact implement grasped on a grip portion thereof, comprising the steps of:

fixing a three dimensional magnetic sensor to the grip portion of the impact implement;

forming magnetic fields, each distribution of intensity and direction thereof being known, within a range of motion of the grip portion, so that the three dimensional magnetic sensor senses magnetism of each of the formed magnetic fields for outputting signals corresponding to three dimensional position of the grip portion with respect to a predetermined point, and to pointing direction of the grip portion with respect to a predetermined direction; and acquiring at least one of three dimensional position coordinates data of the grip portion and pointing direction data of the grip portion from the output signals, wherein;

the impact implement is a golf club; and the three dimensional position coordinates data and the pointing direction data, are acquired during the swing of the golf club; and further wherein;

the three dimensional magnetic sensor fixed to the grip portion has three mutually orthogonal axes for sensing;

one direction of an axis from among the three mutually orthogonal axes being aligned with a direction of an axis of a shaft of the golf club; and one direction of an axis from among the other two axes being aligned with an impact direction of the golf club.

2. The swing measurement method according to claim 1, wherein the three dimensional position coordinates data and the pointing direction data, represent the swing behavior of the grip portion at least from a top state to an impact state of the swing.

3. The swing measurement method according to claim 1, wherein the three dimensional magnetic sensor is fixed to the end of the grip portion.

4. A golf swing analysis method for analyzing a swing behavior of a golf club, comprising the steps of:

receiving time sequence data of three dimensional position coordinates of a grip portion of the golf club, and time sequence data of pointing direction of the grip portion during a golf swing from a data acquisition means;

calculating a swing plane, on which a swing path of the grip portion is approximated, from the time sequence data of the three dimensional position coordinates;

projecting the swing path of the grip portion on the swing plane and approximating the projected swing path as an arc to obtain the arc as a swing path arc of the grip portion; and obtaining:

arm angle time sequence data of an arm angle showing a position of the grip portion on the swing plane from the time sequence data of three dimensional position coordinates and the swing path arc; and at least one time sequence data from the group consisting of:

wrist angle time sequence data of a wrist angle found based on a shaft direction angle obtained from the pointing direction of the grip portion and showing a shaft direction of the golf club on the swing plane, and rotation angle time sequence data of a shaft rotation angle, around a shaft axis of the golf club, from the pointing direction.

5. The golf swing analysis method according to claim 4, wherein the wrist angle is found by subtracting the arm angle from the shaft direction angle.

6. The golf swing analysis method according to claim 4, wherein the swing plane of the grip portion is calculated using the swing path of the grip portion including the swing behavior at least from a top state of the golf swing to an impact state.

7. The golf swing analysis method according to claim 4, wherein the swing path arc of the grip portion is calculated using the projected swing path including the swing behavior at least from a top state of the golf swing to an impact state.

8. The golf swing analysis method according to claim 4, wherein the arm angle time sequence data, and at least one of the wrist angle time sequence data and the rotation angle time sequence data, represent the swing behavior at least from a top state of the golf swing to an impact state.

9. The golf swing analysis method according to claim 4, wherein the swing behavior of the grip portion is analyzed by plotting at least one time sequence data, from among the wrist angle time sequence data and the rotation angle time sequence data, against the arm angle time sequence data.

10. The golf swing analysis method according to claim 4, wherein:

the data acquisition means, which has a three dimensional magnetic sensor and a means for forming magnetic fields, each distribution of intensity and direction thereof being known, so that the three dimensional magnetic sensor corresponding to three dimensional position of the three dimensional magnetic sensor with respect to a predetermined point, and to pointing direction of the three dimensional magnetic sensor with respect to a predetermined direction, acquires the time sequence data of the three dimensional position coordinates and the time sequence data of the pointing direction, by fixing the three dimensional magnetic sensor to the grip portion and forming the magnetic fields within a range of motion of the grip portion during the golf swing.

11. A computer program product, comprising a computer readable medium having computer program code embodied for an analysis of swing behavior of a golf club, the computer program code including:

computer program code configured to cause a computer to receive time sequence data of three dimensional position coordinates of a grip portion of the golf club and time sequence data of pointing direction of the grip portion during a golf swing from a data acquisition means;

computer program code configured to cause a computer to compute a swing plane, on which a swing path of the grip portion is approximated, from the time sequence data of the three dimensional position coordinates;

computer program code configured to cause a computer to project the swing path of the grip portion on the swing plane and approximate the projected swing path as an arc to obtain the arc as a swing path arc of the grip portion; and computer program code configured to cause a computer to obtain:

arm angle time sequence data of an arm angle showing a position of the grip portion on the swing plane from the time sequence data of the three dimensional position data and the swing path arc; and at least one time sequence data from the group consisting of:

wrist angle time sequence data of an wrist angle found based on a shaft direction angle obtained from the time sequence data of the pointing direction and showing a shaft direction of the golf club on the swing plane, and rotation angle time sequence data of a shaft rotation angle, around a shaft axis of the golf club, from the pointing direction.

12. The computer program product according to claim 11, wherein the wrist angle is found by subtracting the arm angle from the shaft direction angle.

13. The computer program product according to claim 11, wherein the swing plane is computed using the swing path of the grip portion including the swing behavior at least from a top state of the golf swing to an impact state.

14. The computer program product according to claim 11, wherein the swing path arc of the grip portion is computed using the projected swing path including the swing behavior at least from a top state of the golf swing to an impact state.

15. The computer program product according to claim 11, wherein the arm angle time sequence data, and at least one of the wrist angle time sequence data and the rotation angle time sequence data, represent the swing behavior at least from a top state of the golf swing to an impact state.

16. The computer program product according to claim 11, wherein the computer program code also includes computer program code configured to cause a computer to plot at least one time sequence data, from among the wrist angle time sequence data and the rotation angle time sequence data, against the arm angle time sequence data.

* * * * *

UNITED STATES PATENT AND TRADEMARK OFFICE

CERTIFICATE OF CORRECTION

PATENT NO. : 6,793,585 B1
DATED : September 21, 2004
INVENTOR(S) : Masahiko Miyamoto et al.

It is certified that error appears in the above-identified patent and that said Letters Patent is hereby corrected as shown below:

Column 12,
Lines 51 and 55, “wherein;” should read -- wherein: --.

Column 13,
Line 59, “sensor corresponding” should read -- sensor senses magnetism of each of the formed magnetic fields for outputting signals corrsponding --.

Signed and Sealed this

Fifth Day of April, 2005

JON W. DUDAS
*Director of the United States Patent and Trademark Office*